United States Patent [19]

Dove

[11] 4,348,975

[45] Sep. 14, 1982

BEST AVAILABLE COPY

[54] SUPPLY BOAT SPOOLING SYSTEM

[76] Inventor: Peter G. S. Dove, 13403 Sea Island Dr., Houston, Tex. 77069

[21] Appl. No.: 96,503

[22] Filed: Nov. 21, 1979

[51] Int. Cl.[3] ..... B63B 21/16; B63B 21/22

[52] U.S. Cl. ..... 114/254; 114/210; 114/268; 43/14

[58] Field of Search ..... 114/254, 268, 210; 43/14

[56] References Cited

U.S. PATENT DOCUMENTS

| | | | |
|---|---|---|---|
| 2,997,188 | 8/1961 | Hauser | 114/268 |
| 3,889,621 | 6/1975 | Pease | 114/254 |
| 4,057,025 | 11/1977 | Piotrowski | 114/210 |

*Primary Examiner*—Richard A. Bertsch

[57] ABSTRACT

This system is for offshore operations and includes a boat having a towing and an anchor handling winch are respectively disposed on the boat deck so as to rotate about horizontal axis. In connection with an offshore rig using chain or cable attached to the anchor, the anchor winch on the boat is used to spool the pendant cable which is attached to the anchor end of the chain until the underwater buoy is brought on the boat deck. The towing cable on the other towing winch is then attached to the buoy cable to suspend the chain and anchor in the water while the pendant cable is disconnected from the buoy cable. The disconnected end of the pendant cable is then connected to a vertical spool on the boat deck and spooled onto the vertical spool from the horizontal anchor handling winch while the chain or cable is being retrieved by an apparatus on the rig.

5 Claims, 2 Drawing Figures

SUPPLY BOAT SPOOLING SYSTEM

BACKGROUND OF THE PRESENT INVENTION

The present invention relates to methods and apparatus for manipulating cable during an anchor chain retrieval operation, and more particularly, to apparatus and methods which enable cable spooling operations to be simultaneously performed during an anchor chain or cable retrieval operation thereby minimizing delay in the overall offshore operation.

Anchor chains or cable moorings are typically used to provide lateral anchoring support for offshore rigs in deep water operations. When the operator desires to move the rig, it is necessary to retrieve the anchoring chains or cable moorings and this operation, typically is time consuming. The anchor chains, at the anchor end of the chain typically has a short length of buoy cable connected to an underwater buoy and a pendant cable extending between the underwater buoy and a surface buoy. In the retrieval operation, to bring the anchor chain onto the rig, a boat is used. The boat operation involves bringing the floating surface buoy aboard the boat and attaching the pendant cable to the anchor-handling-winch.

The anchor-handling-winch then retrieves the cable on the boat and raises the anchor from the sea-bed to permit recovery of the anchoring chain to the rig.

The present invention concerns itself with handling and storage of the pendant cable while the anchoring chain is being recovered by the rig so that as soon as the anchor chain is fully recovered on the rig, the boat is in condition to begin the next recovery operation of an anchoring chain without further delay. By storing the cable on spools on the boat, the cable is protected against damage which might occur if the cable is left lying in loops or loose on the deck.

In accord with the present invention, a boat is provided with an empty anchoring handling winch. The boat is positioned in the water relative to the surface buoy which is attached by pendant cable to an underwater buoy and to the underwater anchor at the end of an anchor chain. The surface buoy is then brought onto the boat deck.

The pendant cable attached to the anchor is made in at least two segments, the lower segment being attached between the anchor on the sea floor and cloverleaf ring containing three connecting apertures or openings. Two of the apertures are connected to ends of the upper and lower pendant cables and the other aperture is connected to the underwater buoy. The empty anchor handling winch on the boat is used to spool the upper pendant cable onto a reel on the boat while lifting the anchor from the floor of the body of water. When the underwater buoy is retrieved on the deck of the boat, the underwater buoy is disconnected. A towing cable, which is located on the towing winch is attached to the aperture on the cloverleaf ring. Once the towing cable is attached to the cloverleaf ring, and the weight of anchor and chain is taken on the towing cable, the pendant cable can be disconnected from the cloverleaf ring. The anchor is then in a relatively fixed depth position in the water while the anchor chain or mooring cable is reeled into the drilling rig. During the period of time that the anchor chain is being retrieved on the drilling rig, the pendant cable end which had been previously attached to the cloverleaf ring is attached to a vertical, empty storage reel which is located to one side of the boat. After connection of the cable, the storage reel is driven to spool the pendant cable from the anchor handling winch to the storage reel. After the pendant cable is entirely wound onto the storage reel, a davit means is used to reposition the storage spool from a vertical spoling reel spindle to another location on the boat deck. Thus, another empty reel can be placed on the spooling reel spindle and together with the empty reel on the anchor-handling-winch on the deck, the boat is then ready to repeat the recovery operation for anchor chain retrieval.

In many instances, the pendant cable comes in such great length that it is interconnected in segments and thus a segment of the cable can be spooled onto the anchor-handling-winch and unspooled while the towing cable holds the remainder of the pendant cable in suspension. Thus, each of the segments can be spooled independently of one another during the time period that the anchor chain is being retrieved. There are significant advantages, of course, in being able to spool the pendant cable on reels such as protecting the cables from damage and preventing coils of cable on the deck. It also facilitates storage of these cables while the boat is moved.

DESCRIPTION OF THE DRAWINGS

The invention may best be understood by reference to the specification and the drawings in which.

DESCRIPTION OF THE INVENTION

Figure 1:
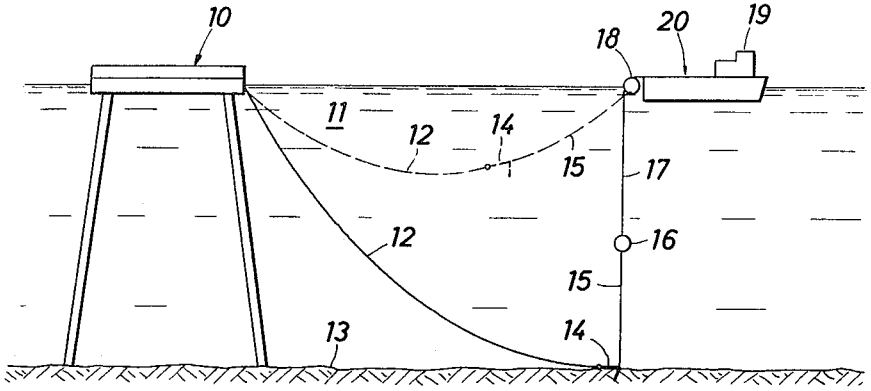
FIG. 1 is a view of a typical offshore anchor chain retrieval operation.

Referring now to FIG. 1, an offshore drilling rig 10 is shown schematically disposed in a body of water 11. One of the anchor chains or mooring cables 12 for the offshore rig is shown depending from the rig 10 and an anchor 14 at the end of a chain connects the chain to the floor 13 of the body of water. The anchor chains 12 are disposed relative to the drilling rig 10 so as to stabilize the rig in a given position.

Attached to each anchor 14 on a chain 12 is a lower buoy cable 15, usually about 200 feet in length which is connected to and held vertical by an underwater buoy. The underwater buoy 16 is connected by an upper pendant cable 17 to a buoy 18 which floats on the surface of the water.

The present invention concerns itself with the operation of collecting the cable 17 while the anchor chain 12 is being collected on the drilling rig 10. According to the present invention, the pendant cable 17 is spooled onto an anchor-handling-winch 19 on a boat 20 which releases the anchor 14 from its position on the bottom of the sea floor 13. When the underwater buoy 16 is retrieved on board the boat, the anchor chain 12 is then held suspended in the body of water by the buoy cable 15. This permits the anchor chain 12 then to be collected on the drilling rig 10 in a conventional manner while the boat maintains the end of the anchor in suspension in the water above the floor of the body of water. The suspension of the chain 12 by the boat is illustrated by the dashed line. While the anchor chain 12 is being collected or reeled into the rig 10, the dependent cable 17 which was collected on the anchor-handling-winch 19 on the boat 20 is then transferred from the anchor-handling-winch 19 to a storage reel as will be explained hereafter. After transfer of the pendent cable, the anchor-handling-winch 19 is immediately available for another spooling operation for retrevial of another anchor chain. Thus, the anchor chain 12, when it is finally collected into the rig 10 and the boat disengaged from the anchor 14, enables the boat 20 immediately to proceed to another anchor chain 12 and begin the retrieval operation with an empty anchor-handling-winch 19 available for spooling another pendant cable.

Figure 2:
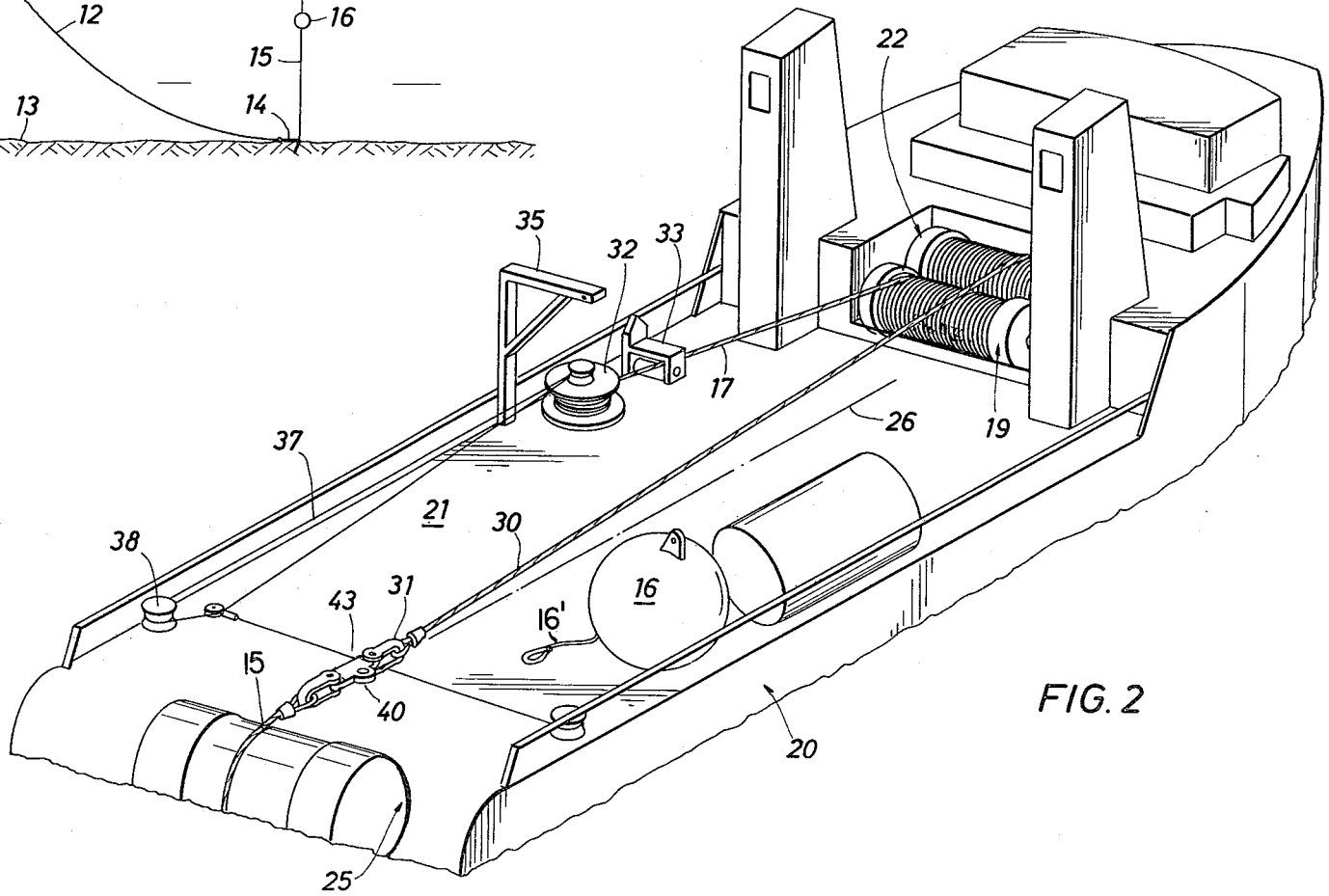
FIG. 2 is a perspective view of a boat deck incorporating features of the present invention.

Referring now to FIG. 2, on the deck section 21 of the boat 20, an underwater buoy 16 is shown in its unattached storage position to one side of the boat. At the rearward end of the boat is a rotating roller 25 for easing the travel of the cable into and out of the water. The roller 25 is constructed of suitable wear-resisting material. Along the central, longitudinal axis 26 of the boat and forward of the rearward roller 25, are a pair of cable winches on reels 19 and 22. One of the cable winches 22 is mounted with its rotational axis transverse to the longitudinal axis 26 and located rearwardly from the lowermost winch 19. Both winches 19 and 22 are power driven so as to be directionally driven in either direction or be free-wheeling as necessary for the operation, and are transverse to the longitudinal axis along the boat. The winch 22 is generally used as the towing winch and contains a conventional towing cable 30 with a suitable connecting loop 31 at its collecting terminal end. To one side and near the rearward end of the boat is a collecting storage spool or reel 32 which is arranged and mounted for rotation about a vertical axis. Disposed between the collector storage reel 32 and the anchor-handling-winch 19 is a spooler leveler guide mechanism 33.

A vertical davit frame means 35 of conventional construction is located next to the vertical storage spool 32 and mounted for rotative movement about a vertical axis. The davit frame means 35 provides the function of removing a storage spool storage 32 from a vertical spindle and locating the storage spool at another location on the deck for storage. The storage spool 32 is driven in this particular embodiment by an endless drive cable 37 coupled to a capstan 38. However, it will be appreciated that a hydraulic or mechanical drive directly connected to the storage spool 32 is equally efficient.

In the illustration shown in FIG. 2, the towing cable 30 on the boat is interconnected with a pendant cable 17 in the water by means of a clover leaf joining ring 40. The clover leaf joining ring 40 consists of a plate member which has 3 bolt openings 43 which are equi-distantly spaced from one another about a central axis of the ring. The cloverleaf joining ring 40 permits interconnection of the towing cables 30 to the pendant cable 17, the buoy cable 15 and the underwater buoy 16 without losing control of the cables.

In the operation of the invention, the boat 20 is located in the water relative to the surface buoy 18. The surface buoy 18 is brought on deck and the pendant cable 17 is then attached to and spooled onto the anchor-handling-winch 22. When the underwater buoy 16 is retrieved on the deck of the boat, the pig tail cable 16' attached to the buoy 16 is disconnected from the ring 40. Next, the free end of towing cable 30 is connected to the vacated opening in the ring 40. Next, the bottom end of the cable 17 is disconnected from the ring 40. At this point in time, the towing cable supports the cable 15 and the anchor 14 as shown by dashed line in FIG. 1. The free and disconnected end of pendant cable 17 on the winch 19 is threaded through the conventional leveler 33 and connected to an empty storage spool 32. The spool 32 is driven by the capstan 38 and cable 37 to transfer the pendant cable 17 from the winch 19 to the storage spool 32. During this operation, the leveler 33 has a guide which moves up and down vertically under a manual or automatic control to guide the cable onto the spool 32 and acts as a level wind device for the spool 32. When the pendant cable 17 or the segment thereof to be stored on the spool 32 is collected on the spool, a cable hoist on the davit means 35 is attached to the spool 32. The cable hoist is operated to raise the spool 32 to disconnect the spool 32 spindle. When the spool 32 is raised vertically by the hoist means a distance adequate to free it from the upper end of the vertical spindle, the davit means 35 is rotated about is vertical axis so as to move the spool 32 from a position over the spindle to a storage position alongside the spindle on the boat deck. This frees the spindle so that another storage spool can be mounted on the spindle to collect another cable. At the same time, the winch 19 is available to receive another cable.

During the time that the cable 17 is being respooled from the winch 22 to the spool 32, the anchor chain 12 is being retrieved on the rig deck. As soon as the chain retrieval on the rig deck is completed, the boat is capable of being moved to another location and immediately performs a second operation of picking up an anchor. This is possible because the anchor-handling-winch 19 is available to spool another cable.

While only selected embodiments of the present invention are illustrated and described herein, other embodiments of the invention are contemplated and many changes and modifications of the inventions may be made within the scope of the appended claims without departing from the spirit of the invention.

I claim:

1. Apparatus on a boat for handling cable used in mooring systems in offshore operations comprising:

a boat for handling cables, said boat having a rearwardly located deck surface arranged for guiding cable between an underwater anchoring location and a spooling location at a forwardly located deck surface on the boat;

at least two independent spooling winches on said deck surface, said spooling winches being located generally centrally of the width of the deck of said boat at said spooling location;

spool means on each of said spooling winches and means for driving said spooling winches rotatably about horizontal axis so that each spooling means may spool or unspool cables independently of one another;

one of said spool means on one of said winches carrying a towing cable and the other of said spool means on the other of said winches being normally empty of cable;

independent storage spool means located intermediate of said rearward deck surface and said spooling location to one side of the length of said deck surface;

mounting means for rotatably driving said storage spool means about its central axis whereby cable on a winch spool means may be transferred to or from one spooling winch to said storage spool means independent of the other spooling winch in the same time frame;

means for releasably coupling said mounting means to said storage spool means; and means proximate to said mounting means for moving a storage spool means onto or off of said mounting means.

2. The mounting means as defined in claim 1 wherein said mounting means includes frame means rotatable about a vertical axis and having a horizontal extension, said frame means being located relative to said mounting means, whereby said horizontal extension can be rotated between a position over said mounting means and a position permitting storage of storage spool means, and means on said frame means for vertically moving a storage spool means.

3. The mounting apparatus as defined in claim 1 and further including a cable leveling means disposed between said storage spool means and said other winch, said leveling means having vertically movable guide means for level winding of cable onto a storage spool means.

4. The mounting apparatus as defined in claim 1 wherein said mounting means includes a vertical spindle on which said storage spool means in received.

5. Apparatus on a boat for handling cable used in mooring systems in off shore operations comprising:

a boat for handling cables in off shore operations, said boat having a rearward extending deck surface which has a rearward surface arranged to pass cable over the end of the boat and into the water from a spooling means located on the deck surface at a winch location intermediate the length of the boat;

at least three spooling means for cable on said boat deck surface where two of said spooling means are located intermediate of the length of the boat so as to spool or unspool cable with respect to the end of the deck, one of said two spooling means carrying a towing cable and the other of said spooling means being empty of cable;

the remaining spooling means being vertically located on the deck surface so as to accept cable from one of said two spooling means, said remaining spooling means being arranged for independent rotation about vertical axis and being located intermediate of the rear surface of the boat and the other two spooling means, drive means for each of said spooling means for independently and selectively driving said spool means whereby said vertical spooling means can cooperate with at least one of said two rearward spooling means at any time with said vertical spooling means permitting independent cable spooling operations to be made in the same time frame by each of said rearward spooling means.

* * * * *